US006871373B2

(12) United States Patent
Driesen et al.

(10) Patent No.: US 6,871,373 B2
(45) Date of Patent: Mar. 29, 2005

(54) BRISTLE FOR A TOOTHBRUSH, PARTICULARLY FOR AN ELECTRIC TOOTHBRUSH, AND METHOD FOR ITS MANUFACTURE

(75) Inventors: Georges Driesen, Weilrod (DE); Ahmet C. Firatli, Wiesbaden (DE); Rainer Hans, Waldems (DE); Armin Schwarz-Hartmann, Wendelsheim (DE)

(73) Assignee: Braun GmbH, Kronberg (DE)

( * ) Notice: Subject to any disclaimer, the term of this patent is extended or adjusted under 35 U.S.C. 154(b) by 164 days.

(21) Appl. No.: 09/803,132

(22) Filed: Mar. 9, 2001

(65) Prior Publication Data

US 2001/0016963 A1 Aug. 30, 2001

Related U.S. Application Data

(63) Continuation of application No. PCT/EP99/04577, filed on Jul. 2, 1999.

(30) Foreign Application Priority Data

Sep. 14, 1998 (DE) ..... 198 41 974

(51) Int. Cl.[7] ..... A46B 9/02; D01F 6/00

(52) U.S. Cl. ..... 15/167.1; 15/207.2; 15/DIG. 6; 428/373; 428/364; 428/397; 300/21; 264/243

(58) Field of Search ..... 15/167.1, 207.2, 15/DIG. 6; 428/397, 398, 373, 364, 374; 300/21; 264/243

(56) References Cited

U.S. PATENT DOCUMENTS

| | | | | |
|---|---|---|---|---|
| 3,117,362 A | | 1/1964 | Breen | 57/140 |
| 3,173,163 A | | 3/1965 | Cramton | 15/159 |
| 4,802,255 A | | 2/1989 | Breuer et al. | 15/159 |
| 4,821,359 A | | 4/1989 | Deziel et al. | 15/159 |
| 4,979,782 A | | 12/1990 | Weihrauch | 300/4 |
| 5,128,208 A | | 7/1992 | Bond et al. | 428/397 |
| 5,133,590 A | | 7/1992 | Fitjer | 300/21 |
| 5,313,909 A | | 5/1994 | Tseng et al. | 116/208 |
| 5,786,087 A | * | 7/1998 | Cansler | 15/207.2 |
| 5,933,906 A | | 8/1999 | Rackley | 15/167.1 |
| 6,094,769 A | | 8/2000 | Driesen et al. | 15/207.2 |
| 6,141,819 A | | 11/2000 | Driesen et al. | 15/207.2 |
| 6,161,243 A | | 12/2000 | Weihrauch | 15/167.1 |
| 6,506,327 B2 | | 1/2003 | Weihrauch | 264/146 |

FOREIGN PATENT DOCUMENTS

| | | | |
|---|---|---|---|
| DE | 2 307 324 | 6/1973 | D01D/5/22 |
| DE | 195 33 815 | 3/1997 | |
| DE | 29700 611 U | 4/1997 | A46D/1/00 |
| DE | 196 40 726 A1 | 4/1998 | |

(Continued)

OTHER PUBLICATIONS

Patent Abstract of Japan 73037045 B (1973), Derwent–Acc–No. 1973–69071U.

Patent Abstract of Japan 74018988 B (1974), Derwent–Acc–No. 1974–42865V.

(Continued)

*Primary Examiner*—Gary K. Graham
(74) *Attorney, Agent, or Firm*—Edward S. Podszus

(57) ABSTRACT

The invention is directed to a bristle for a toothbrush, particularly for an electric toothbrush, and to a method for its manufacture. The bristle is manufactured from a monofilament (5) made of plastic. The bristle has in its cross section at least two zones (6, 7) and at least one point of preferred breaking.

46 Claims, 6 Drawing Sheets

FOREIGN PATENT DOCUMENTS

| | | | | |
|---|---|---|---|---|
| DE | 196 40 852 | | 4/1998 | |
| DE | 196 40 853 | | 4/1998 | |
| DE | 19640853 | * | 4/1998 | |
| DE | 197 48 733 | | 5/1999 | |
| EP | 0 450 210 | | 10/1991 | |
| JP | 2-169720 | | 6/1990 | D01F/8/06 |
| JP | 2-169722 | | 6/1990 | D01F/8/14 |
| JP | 2-169723 | | 6/1990 | D01F/8/14 |
| JP | 3-199424 | | 8/1991 | D01F/6/66 |
| JP | 3-199425 | | 8/1991 | D01F/8/06 |
| JP | 3-199426 | | 8/1991 | D01F/9/12 |
| JP | 5-51818 | | 3/1993 | D01F/8/12 |
| JP | 5-331773 | | 12/1993 | D06M/15/643 |
| JP | 5-331774 | | 12/1993 | D06M/15/693 |
| JP | 5-331775 | | 12/1993 | D06M/17/00 |
| JP | 7-197322 | | 8/1995 | D01F/8/04 |
| JP | 8-284019 | | 10/1996 | D01F/8/06 |
| WO | WO 92/10114 | | 6/1992 | A46D/1/05 |
| WO | WO 98/48086 | | 10/1996 | D01D/5/08 |
| WO | WO 96/39117 | | 12/1996 | A61K/7/16 |
| WO | WO 96/41041 A1 | | 12/1996 | |
| WO | WO 97/03589 A1 | | 2/1997 | |
| WO | WO 97/14830 | | 4/1997 | D01F/8/04 |
| WO | WO 99/24649 | | 5/1999 | |

OTHER PUBLICATIONS

Translation of PCT application corresponding to DE 196 40 852 published Apr. 16, 1998.

Translation of PCT application corresponding to DE 196 40 853 published Apr. 16, 1998.

Patent Abstracts of Japan vol. 15, No. 467 (C–0888), Nov. 27., 1991 & JP 03 199425 A (Daiwabou Kurieito KK), Aug. 30., 1991, Abstract.

Patent Abstracts of Japan vol. 1997, No. 2, Feb. 28., 1997 & JP 08 284019 A (Japan Vilene Co LTD), Oct. 29., 1996, Abstract.

* cited by examiner

BRISTLE FOR A TOOTHBRUSH, PARTICULARLY FOR AN ELECTRIC TOOTHBRUSH, AND METHOD FOR ITS MANUFACTURE

This is a continuation of International Application No. PCT/EP99/04577, pending, with an International filing date of Jul. 2, 1999.

FIELD OF THE INVENTION

This invention relates to a bristle for a toothbrush, particularly for an electric toothbrush, which is manufactured from a monofilament formed of plastic. The invention relates likewise to a method for manufacturing a bristle for a toothbrush, particularly for an electric toothbrush, in which a monofilament is manufactured from plastic.

BACKGROUND

A bristle of said type and a method of said type are known from German Offenlegungsschrift DE 196 45 852 A1. This specification contains a description of a monofilament having a non-circular cross section. Subsequent to being extruded the monofilament is twisted about its longitudinal axis and fixed with the aid of chemical agents. This results in a three-dimensionally structured surface which produces a better cleaning effect, particularly when removing plaque.

From German Offenlegungsschrift DE 196 40 853 A1 there is known a bristle for a toothbrush, being comprised of plastic and having several interconnected filaments. Said filaments are wound or braided and joined together with the aid of chemical agents. At the free end of the bristle manufactured from these filaments a fanning effect is accomplished by subjecting the free end of the bristle to a mechanical processing operation, for example.

It is also known to perform such fanning of the free end of a bristle in cases where a monofilament is involved. In this case it is necessary for the free end of the bristle to be processed by a cutting tool or the like.

SUMMARY OF THE INVENTION

It is an object of the present invention to provide a bristle manufactured from a monofilament, with the possibility of fanning the free end of the bristle in simple manner.

This object is accomplished by the invention with a bristle of the type initially referred to in that the bristle has at least two zones plus at least one point of preferred breaking in its cross section. Further, the object is accomplished with a method of the type initially referred to in that the monofilament is manufactured in such a way that it has at least two zones plus at least one point of preferred breaking in its cross section.

One or several points of preferred breaking are formed within the monofilament by the zones which according to the invention exist in the cross section of the monofilament and are filled preferably with plastic. These points of preferred breaking are approximately located where the at least two zones adjoin one another. A bristle manufactured from such a monofilament no longer requires the use of elaborate cutting tools or the like for it to be fanned at its free end. Instead it suffices for the free end of the bristle to be mechanically processed. Such mechanical processing can be performed, for example, by upsetting, knocking, rounding, cutting, grinding, polishing or beating the free end of the bristle. As a result of this mechanical processing of the free end of the bristle, the different zones present in cross section will break at the described points of preferred breaking. Hence there will result at the free end of the bristle at least two sub-filaments corresponding to the at least two zones of the original monofilament. If the original monofilament has a multiplicity of zones in cross section, the mechanical processing of the free end of the bristle will result in a mutiplicity of sub-filaments corresponding to said zones, which is equivalent to fanning the free end of the bristle. At the same time it is advantageously possible to fill tie two zones with plastic. The thickness of the bristles may lie between 0.1 mm and 0.25 mm, preferably between 0.15 mm and 0.18 mm. The cross section of the bristle may take on essentially the form of a three- or multiple-leaf clover or a three- or multiple-point star. The circumferential surface of the monofilament 1, 15 may advantageously have a helical structure 9 as shown in FIG. 5.

An essential point is that the free end of the bristle no longer needs to be processed with elaborate cutting tools or the like. Instead it suffices for the free end of the bristle to be mechanically processed in order to effect fanning of the free end. This fanning contributes to enhancing the cleaning effect, particularly when the bristle is used in interproximal areas, in addition to improving the surface polishing effect in combination with abrasives contained in the dentifrice. In particular it is possible for the mechanical processing for the fanning to be performed by the process required in any case to round the free ends of the bristles, thus eliminating the need for an additional processing step such as cutting the bristles.

Using the monofilament also means that it is not necessary to manufacture the bristle from several filaments by winding or braiding in order, by means of mechanical processing, to split open the free end of the resulting bristle. The sometimes great effort required to manufacture a bristle from several filaments is thus eliminated, without resulting in an elaborate separate additional processing step for fanning the free end of the bristle.

All in all the invention thus enables a bristle to be manufactured from a monofilament in simple manner, making fanning of the free end of the bristle possible in simple manner.

In a preferred embodiment of the invention the zones are manufactured from various plastics and/or a plastic and a cavity. This is achieved by fabricating the zones from the various plastics and with cavities or hollow channels during the extrusion of the monofilament.

Similarly it is possible for the zones to be manufactured from various filler materials and/or various colors.

In the previously described first embodiment the points of preferred breaking occur in the transition regions or interfaces between the zones, the various plastics or cavities, or between the various filler materials and/or the various colors. It is thus possible—as described—to fan the free end of the bristle without major effort. By using various plastics it is also possible to invest the monofilament with specific characteristics. Hence it is not only possible to achieve a better cleaning effect with the free end of the bristle by fanning said free end but also to invest the bristle with specific characteristics by using various plastics.

In an advantageous embodiment of the invention the zones are manufactured by dividing and subsequently rejoining the mass flow during extrusion of the monofilament. This is achieved by first dividing the mass flow during extrusion of the monofilament into several strands and then bringing these strands together again in a joint strand. In this case the zones may be comprised of the same plastic, the point of preferred breaking being formed at the interface of the zones. As the result of dividing and subsequently rejoining the mass flow, an intimate bond is prevented from occurring between the plastic of the various strands in those transition regions where the individual strands are brought back together again. This may be effected by making a general adjustment to the temperature control of the plastic or the extrusion die. These transition regions represent points of preferred breaking which—as previously explained—may be transformed into a fanned arrangement by simple mechanical processing. With this second embodiment it is thus possible by dividing and re-joining the plastic flow to fan the bristle developing from the monofilament with little effort.

In a particularly advantageous implementation of the embodiments of the invention, the free end of the bristle is split open by rounding the free end of the bristle. Hence there is no need of a special additional manufacturing step for fanning the free end of the bristle. Instead the fanning or splitting open of the free end of the bristle occurs during the rounding of this end, which is a manufacturing step that is performed in any case. Instead of what are essentially two manufacturing steps, namely the rounding of the ends and a separate splitting operation, the invention thus eliminates the second manufacturing step.

In a further advantageous embodiment of the invention the monofilament is drawn for twisting either from a rotating central reel or from a stationary central reel by means of a rotating nozzle. With the second alternative in particular it is possible to achieve a particularly high speed for drawing the monofilament from the reel. Hence the method for manufacturing the monofilament is further accelerated.

Further features, application possibilities and advantages of the present invention will become apparent from the subsequent description of embodiments of the invention illustrated in the Figures of the accompanying drawings. It will be understood that any features described or represented by illustration, whether used singularly or in any combination, form the subject-matter of the present invention, irrespective of their summary in the claims or their back reference and irrespective of their wording and representation in the description and the drawings, respectively. In the drawings,

DETAILED DESCRIPTION OF PREFERRED EMBODIMENTS

Figure 1A:
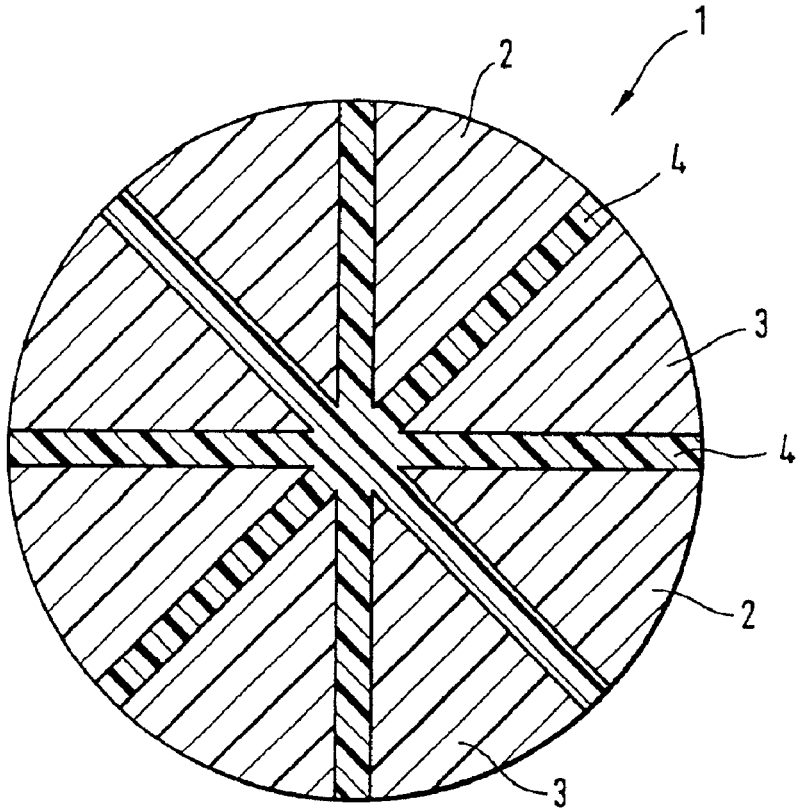
FIG. 1*a* is a schematic view, in cross section, of a monofilament illustrating a first embodiment, comprising two or more pairs of plastic materials, one zone being essentially star-shaped while the other zones are shaped in an essentially segmental or sectoral configuration.

FIG. 1*a* shows the first embodiment of a monofilament 1 in a cross sectional view. The monofilament 1 has several zones 2, 3 and 4, of which at least zone 4 on the one hand and zones 2, 3 on the other hand are manufactured from plastics with different properties. In addition, it is also possible, of course, to arrange different plastics in the zones 2, 3, which may also have differences to the plastic in zone 4. The zones 2, 3 are separated from each other by the zone 4, with the possibility for the plastic in zones 2, 3 to have different filler materials or colors. The zone 4 may be constructed of bars arranged in star shape and essentially positioned in point symmetry and/or mirror symmetry with the central longitudinal axis of the monofilament 1. The zones 2, 3 are constructed in segment or sector form between the bars of zone 4 arranged in star shape. In this embodiment there are a total of eight zones 2, 3, but it will be understood, of course, that any number of zones 2, 3 and 4 may be selected.

Figure 1B:
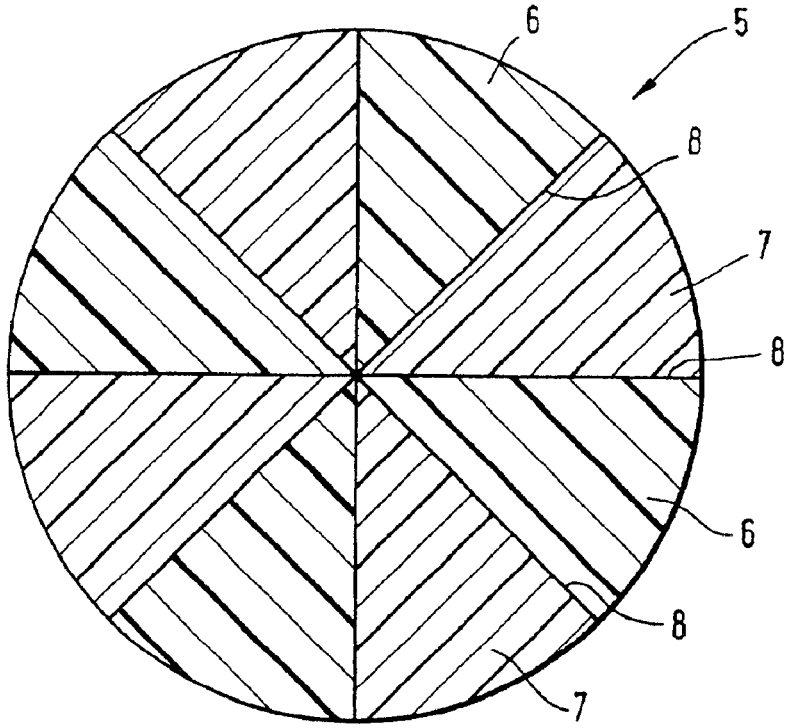
FIG. 1*b* is a schematic view, in cross section, of a monofilament illustrating a second embodiment, having zones shaped in a segmental or sectoral configuration.

The monofilament 5 seen in the cross sectional view shown in FIG. 1*b* has successive zones 6, 7, each of which is constructed in segment form. The zones 6 of the monofilament 5 are filled with a first plastic, for example, while the zones 7 are filled with the second of the two different plastics. It is also possible, however, for all zones 6, 7 to be formed by one and the same plastic, in which case a not too intimate bond at the interfaces of the adjoining zones 6, 7 is assured by suitable process control of the extrusion operation, which involves temporarily dividing the extrusion material during extrusion into several strands corresponding to the zones 6, 7 which are then brought back together again.

The zones 6, 7 of the monofilament 5 form so-called points of preferred breaking in their adjoining transition regions 8. These points of preferred breaking will be explained in greater detail with reference to FIG. 4.

Polyamide or polyester are preferably used for the two described plastics. Combinations of PA 6.12 and polyester or PA 6.12 and PA 6 or PA 6.12 and polyester in particular have proven to be advantageous.

Figure 2A:
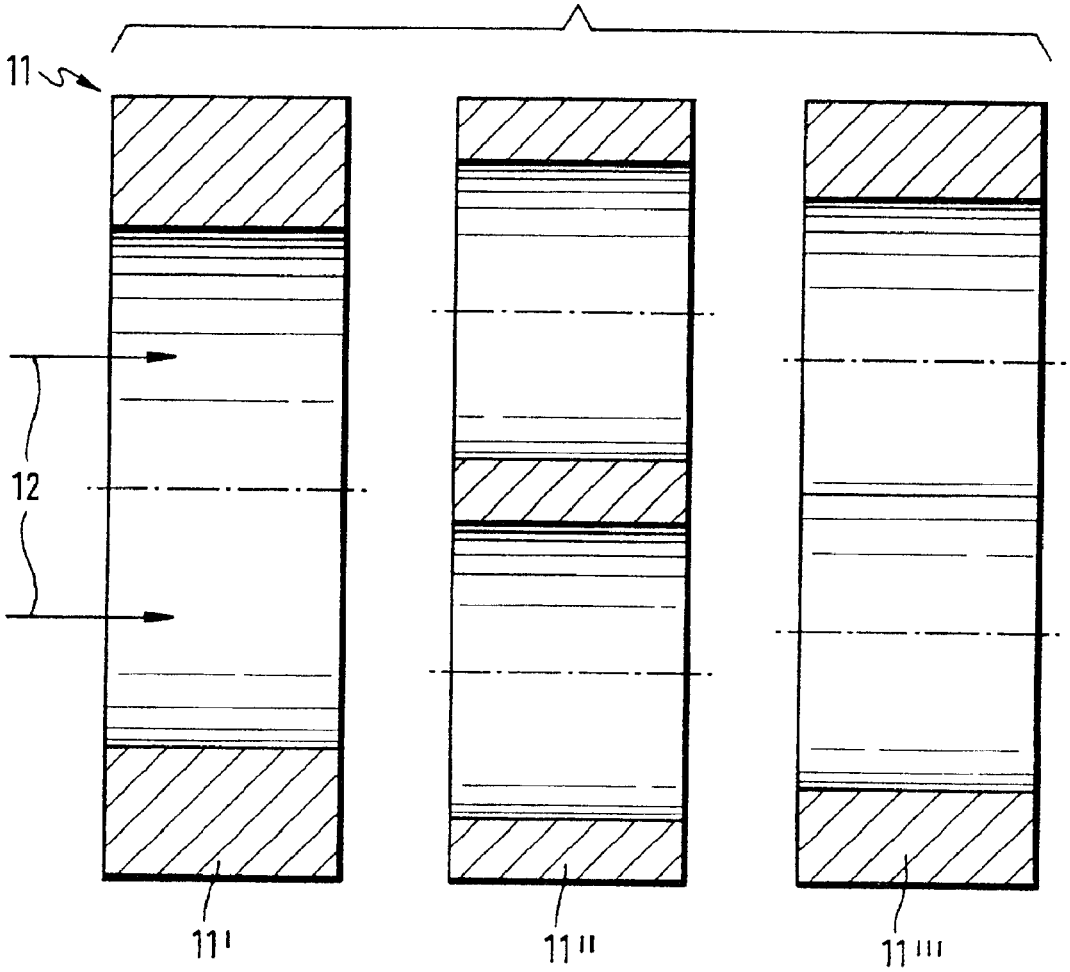
FIG. 2*a* shows schematic longitudinal sectional views of an embodiment of an extrusion die used for manufacturing a monofilament.

FIG. 2*a* shows an extrusion die 11 for manufacturing a monofilament. The plastic for manufacturing the monofilament is fed as a mass flow in the direction of the arrow 12 through the three successive parts 11', 11", 11'" of the extrusion die 11.

In part 11" of the extrusion die 11 the mass flow of plastic is divided into three strands. Afterwards these strands are brought together into a joint strand again in part 11'" of the extrusion die 11. The monofilament finally leaves the extrusion die 11 in the form of this last mentioned joint strand.

Figure 2B:
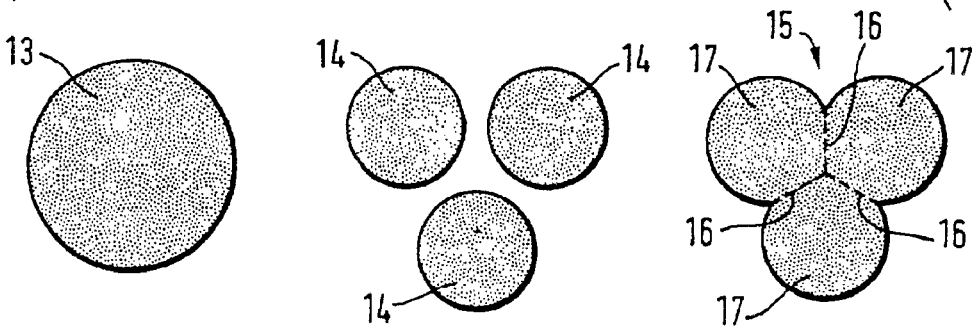
FIG. 2*b* shows schematically cross sectional views of the monofilament as it passes through the extrusion die of FIG. 2*a;*

FIG. 2*b* shows the area of cross section of the mass flow, that is, of the resulting strands of the manufactured monofilament as found at the respective parts 11', 11", 11'" of the extrusion die 11. In part 11' of the extrusion die 11 the monofilament still exists as a uniform mass flow 13 with a uniform area of cross section. Dividing the mass flow inside part 11" of the extrusion die 11 results in accordance with FIG. 2*b* in three independent strands 14. After these strands 14 are brought together again in part 11'" of the extrusion die 11 these formerly independent strands again form one common strand 15 as shown in FIG. 2*b*. This strand 15 is the monofilament as it eventually exits the extrusion die 11.

Dividing the mass flow 13 into the individual strands 14 and bringing these independent strands 14 back together again in the common strand 15 produces zones referred to as points of preferred breaking in the transition regions 16 in which the formerly independent strands 14 adjoin each other, forming the common strand 15. Three zones 17 are separated from each other by these transition regions 16 over the cross section of the common strand 15.

Figure 4:
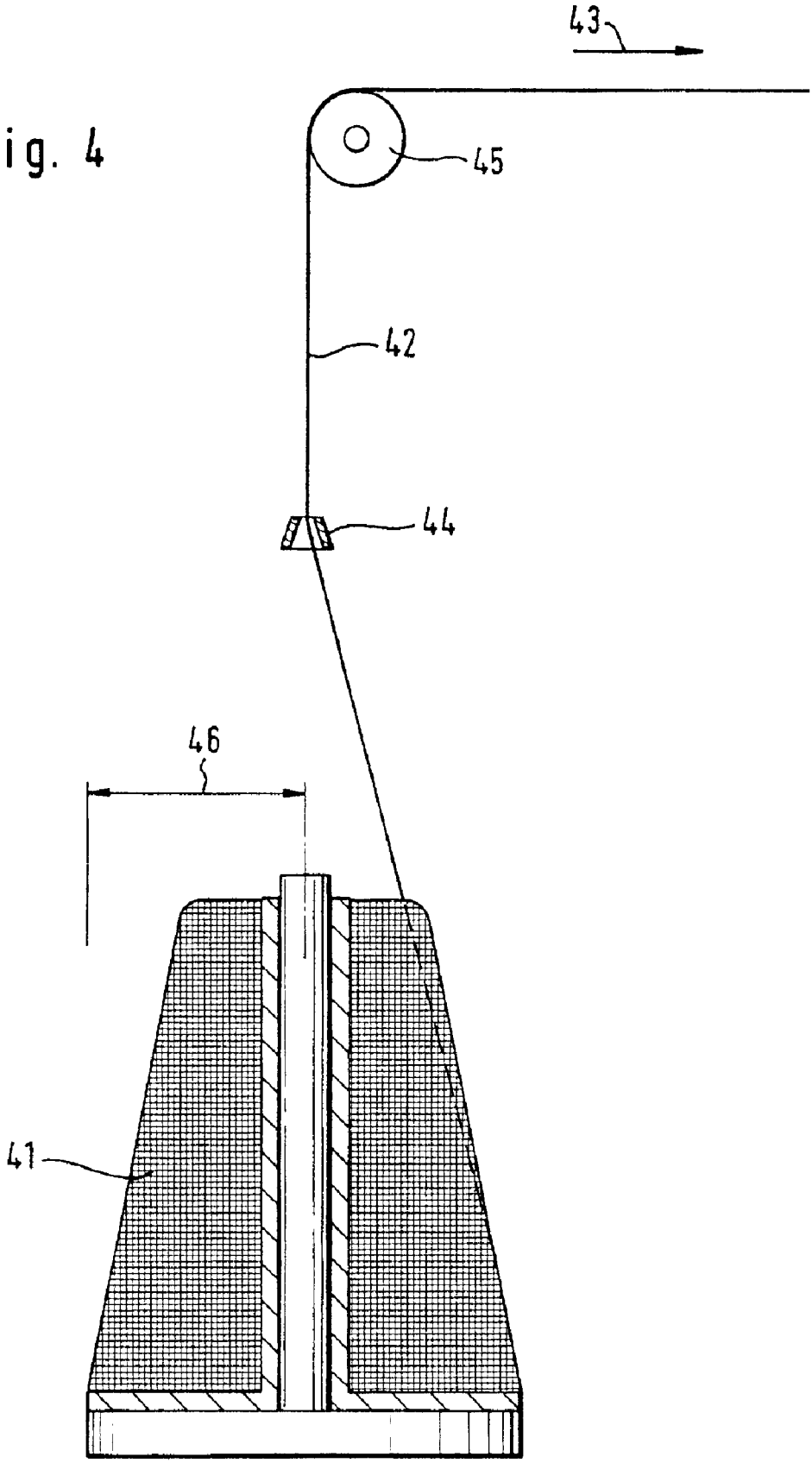
FIG. 4 is a schematic side view of a reel from which a monofilament is drawn.
Figure 5:
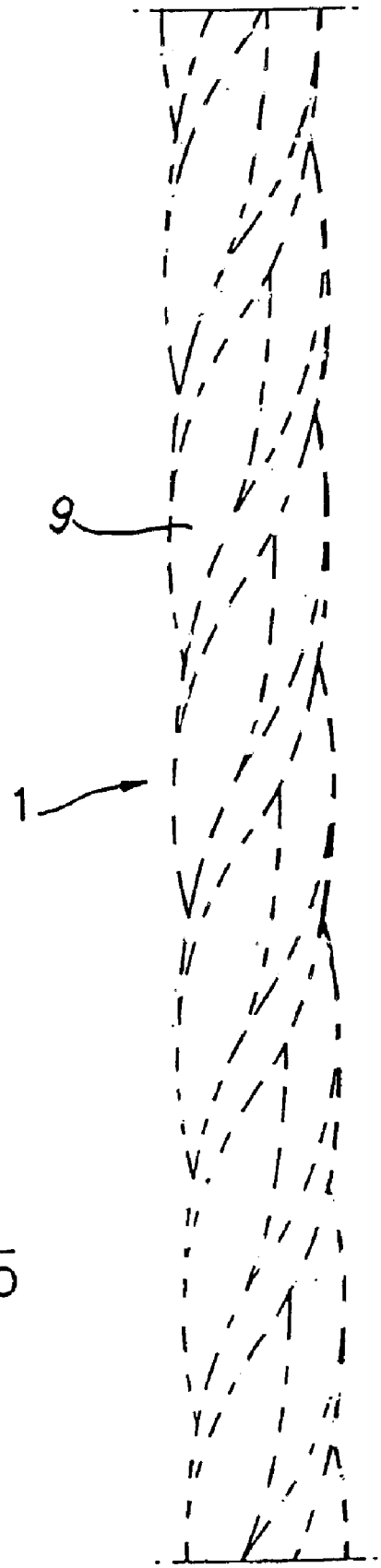
FIG. 5 is a schematic showing of a bristle 1, 15 whose circumferential surface has a helical structure 9.

The points of preferred breaking will be considered in greater detail with reference to FIG. 4.

Polyester or polyamide, for example, are used as plastic for the mass flow 13 of the monofilament. Dividing the mass flow 13 into the individual strands 14 and hence into the zones 17 of the common strand 15 is performed in such a way that the zones 17 occupy approximately equal fractions of the overall cross sectional area of the common strand 15.

Figure 3A:
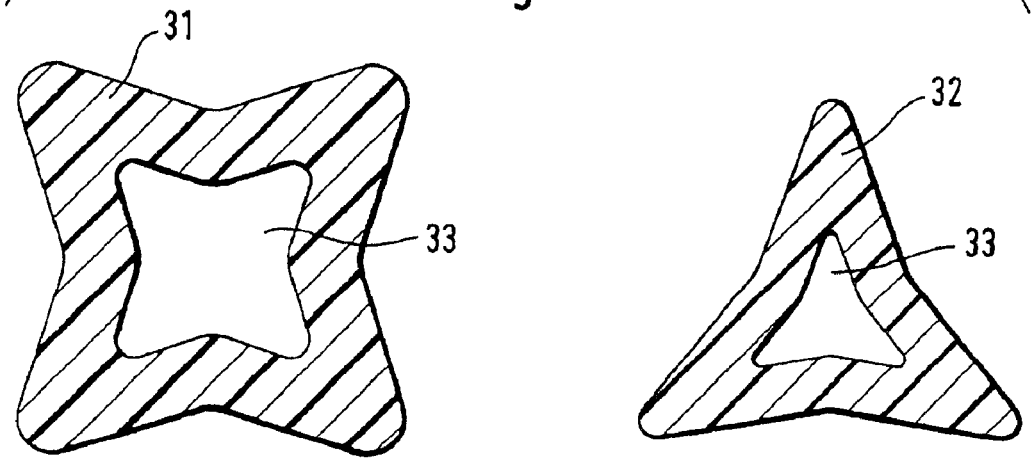
FIG. 3*a* is a schematic cross sectional view of an embodiment of a monofilament having a non-circular cross section and a cavity or a further plastic in longitudinal direction.
Figure 3B:
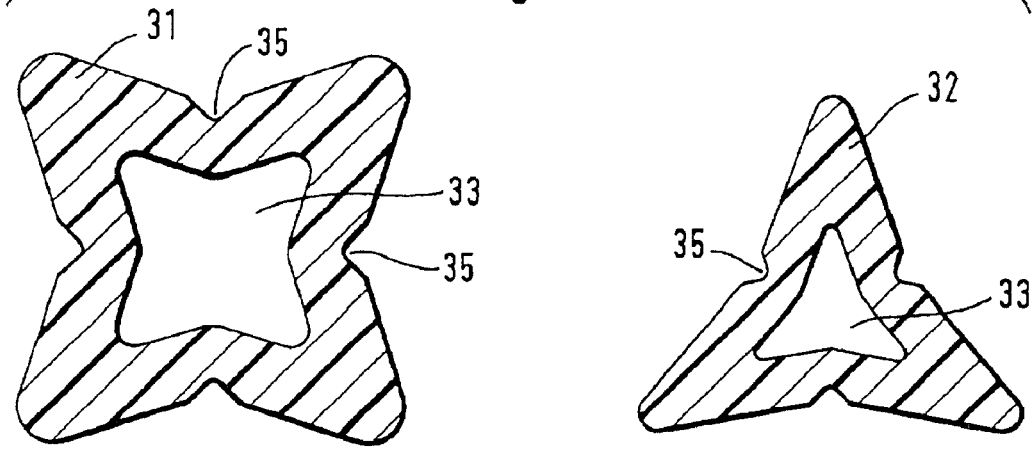
FIG. 3*b* is a schematic cross sectional view of an embodiment of a monofilament having a non-circular cross section, a cavity or a further plastic, and points of preferred breaking in longitudinal direction.
Figure 3C:
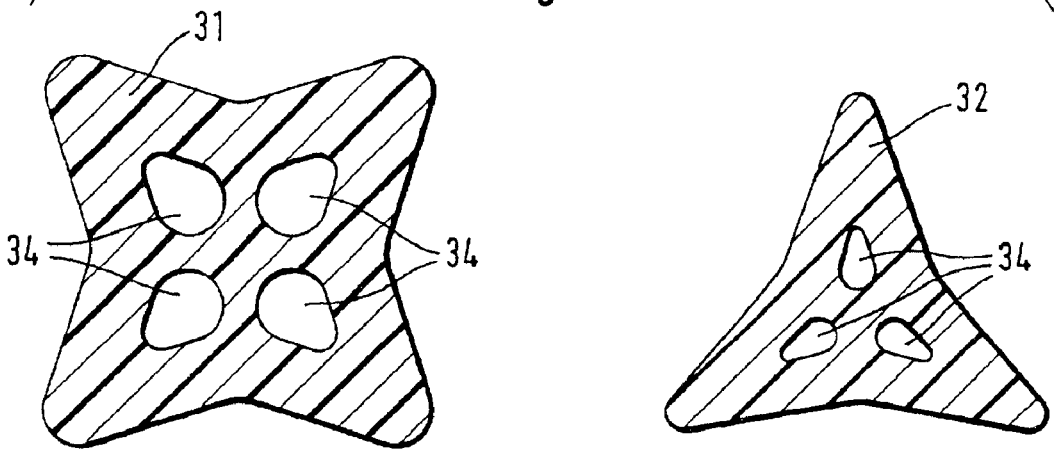
FIG. 3*c* is a schematic cross sectional view of an embodiment of a monofilament having a non-circular cross section and several cavities or a further plastic in longitudinal direction.

Further cross sections of monofilaments made of plastic are shown in FIGS. 3*a*, 3*b* and 3*c*. All the illustrated monofilaments have a non-circular cross section. The monofilaments have an essentially star-shaped cross section with three or four points.

In FIGS. 3*a* and 3*b* the inside of the illustrated monofilaments 31, 32 is equipped in each instance with a respective cavity 33 extending in the longitudinal direction of the monofilaments 31, 32. The cavity 33 has a cross sectional form that is essentially like the corresponding monofilament 31, 32. In FIG. 3*c* the inside of the monofilaments 31, 32 is equipped in each case with several cavities 34 extending in longitudinal direction. The cross sectional form of these several cavities 34 does not correlate to the cross-sectional form of the corresponding monofilament 31, 32. It is also possible, however, for the cavities 33 to be filled with a further plastic so that points of preferred breaking are produced by the phase boundaries of contiguous zones and suitable constrictions or tapers in one of the zones.

In FIG. 3*b* the illustrated monofilaments 31, 32 are equipped with points of preferred breaking 35 extending in longitudinal direction. The points of preferred breaking 35 are produced by notching from the outside the wall lying between the outside and the cavity 33 which forms the respective monofilament 31, 32. Hence the thickness of the wall is reduced at this point, causing the monofilament 31, 32 to break more easily at this point.

The described point of preferred breaking 35 will be considered in greater detail with reference to FIG. 4.

As was previously explained, it is possible to manufacture a monofilament 5 having several zones 6, 7 in its cross section which are filled with various plastics. As was also explained, an extrusion die 11 can be used for manufacturing a monofilament 15 comprised of a single plastic but likewise displaying several zones 17 in its cross section.

As was described with reference to FIGS. 3*a*, 3*b*, 3*c*, there are further monofilaments 31, 32 equipped with one or more cavities 33, 34 which can be filled with a further plastic.

After being manufactured these monofilaments are wound on a reel. The further procedure for manufacturing bristles for a toothbrush from said monofilaments will now be described with reference to FIG. 4.

A first possibility includes setting the reel 41 shown in FIG. 4 in rotation about its axis and drawing the monofilament 42 off the reel in the direction of the arrow 43.

In a second possibility the reel 41 is stationary and the monofilament 42 is unwound from the reel 41 with the aid of a rotating nozzle and drawn in the direction of the arrow 43.

In both possibilities the monofilament 42 is directed through a guide nozzle 44 and deflected by means of a deflector reel 45.

On account of the small radius 46 of the reel 41 it is possible for the monofilament 42 to be drawn at very high speed from the reel 41 in the direction of the arrow 43.

The rotary unwinding motion of the monofilament 42 from the reel 41 causes the monofilament 42 to be twisted about its longitudinal axis. Downstream from the deflector reel 45 the monofilament 42 is exposed to chemical agents which fix the monofilament 42. The chemical agents result in particular in the torsion of the monofilament 42 being fixed or frozen.

After the monofilament 42 is fixed, it is cut and processed into individual bristles of approximately equal length. The bristles are then grouped in tufts and fixed to a bristle carrier, for example, as shown schematically on carrier 55 in FIG. 6.

In a further manufacturing step the free ends of the individual bristles are rounded. For this purpose the free ends are subjected to a mechanical processing operation. It is possible, for example, for all the free ends of the bristles in a tuft of bristles to be rounded by processing with a grinding disk. This results in the free ends of the individual bristles no longer being pointed but round in construction.

The mechanical processing of the free ends of the individual bristles in order to make the ends round also results, when using the described monofilaments, automatically in the fanning or splitting of the free ends of the individual bristles. As the result of the mechanical processing of the free ends of the bristles, which is necessary to round off the free ends, the free ends of the bristles break open at the points of preferred breaking of the monofilaments. This is equivalent to splitting or fanning the free ends of the bristles.

If a monofilament according to FIG. 1*b* is used, the points of preferred breaking 8 of the monofilament 5 will break open at the free end of the bristle in question. Hence a total of eight individual sub-filaments are formed at the free end of the bristle.

If a monofilament according to FIG. 2*b* is used, the three zones 17 of the common strand 15 will break open at the free end of the bristle. Hence three separate sub-filaments are formed at the free end of the bristle.

If monofilaments according to FIGS. 3*a*, 3*b*, 3*c* are used, these monofilaments will break open in particular at the points of preferred breaking 35. Individual sub-filaments are thus formed at the free ends of the bristles.

Hence the mechanical processing of the free ends of the bristles required for rounding said ends results simultaneously in the splitting of the free ends of the bristles in their longitudinal direction. Depending on the type and intensity of mechanical processing applied to the free ends of the bristles it is possible to control the extent to which the bristles split in longitudinal direction. Splitting preferably extends over approximately 10% to approximately 25% of the length of the bristle.

The bristles and tufts of bristles 1, 15 manufactured by this method are used preferably in an electric toothbrush 60.

Figure 6:
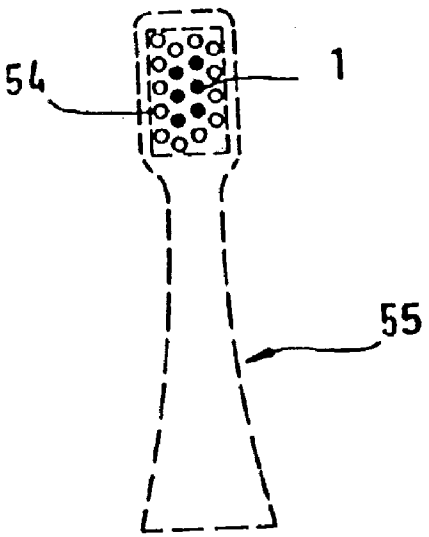
FIG. 6 is a schematic view of a toothbrush formed by bristles on a carrier 55.
Figure 7:
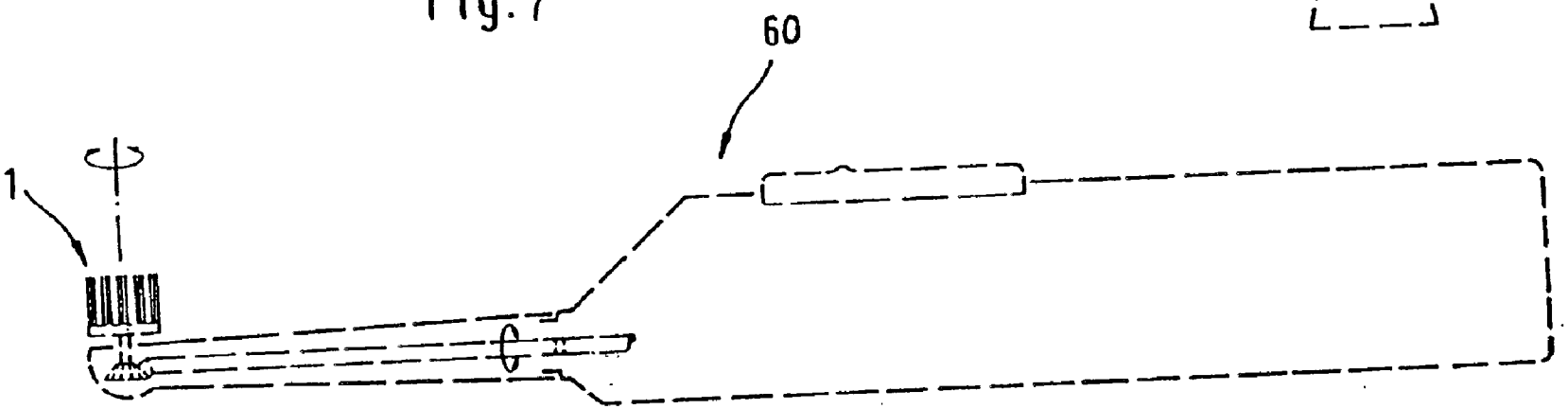
FIG. 7 is a schematic view of a field of bristles on an electric toothbrush 60.

FIG. 6 shows a field 54 of bristles 1, 15. They are intended for use in particular in a round headed toothbrush, preferably within its inner field.

We claim:

1. A toothbrush bristle and a bristle carrier together forming a toothbrush, said bristle comprising a plastic monofilament defining in a cross-sectional area thereof at least first and second adjoining zones and at least one region of preferred breaking between said first and second zones, said first and second zones being defined from a divided mass flow that is rejoined along an interface to define said at least one region of preferred breaking, said interface being substantially free of an internal void, wherein a free end of the bristle is rounded, and at the end of said toothbrush bristle remote from said carrier said first zone being separated from said second zone by breakage along said interface.

2. The toothbrush as claimed in claim 1, wherein the first zone comprises a first plastic material and the second zone comprises a second plastic material, and wherein said first plastic material differs from said second plastic material.

3. The toothbrush as claimed in claim 1, wherein the first and second zones each comprise a first plastic material.

4. The toothbrush as claimed in claim 1, wherein at least one said zone defines a cavity.

5. The toothbrush as claimed in claim 4, further comprising a second plastic material contained within said cavity and extending across at least a portion of a cross-sectional area of the cavity.

6. The toothbrush as claimed in claim 5, wherein said second plastic material fills the cross-sectional area of the cavity.

7. The toothbrush as claimed in claim 5, wherein said second plastic material is different from a plastic material defining a portion of a boundary of said cavity.

8. The toothbrush as claimed in claim 1, wherein at least one said zone comprises at least one filler material.

9. The toothbrush as claimed in claim 1, wherein at least one said zone comprises a colorant.

10. The toothbrush as claimed in claim 1, wherein the region of preferred breaking is defined in a plastic extrudate.

11. The toothbrush as claimed in claim 1, wherein said zones are arranged in approximately minor symmetry with an axis of the bristle.

12. The toothbrush as claimed in claim 1, wherein said zones are arranged approximately in point symmetry with an axis of the bristle.

13. The toothbrush as claimed in claim 1, wherein said first and second zones each occupy approximately equal portions of the cross-sectional area.

14. The toothbrush as claimed in claim 1, wherein the free end of the is split preferred breaking region directed along a longitudinal axis of the bristle.

15. The toothbrush as claimed in claim 14, wherein the split region extends between approximately 10% and approximately 25% of a length of the bristle.

16. The toothbrush as claimed in claim 1, wherein the bristle comprises a plastic selected from a group of plastics consisting of polyester, polyamide and mixtures thereof.

17. The toothbrush as claimed in claim 1, wherein a major lateral dimension of the cross-sectional area of the monofilament is between 0.1 mm and 0.25 mm.

18. The toothbrush as claimed in claim 17, wherein the lateral dimension is between 0.15 mm and 0.18 mm.

19. The toothbrush as claimed in claim 17, wherein the lateral dimension is a diameter.

20. The toothbrush as claimed in claim 1, wherein the cross-sectional area comprises a shape selected from a group of shapes consisting of a three-leaf clover, a multiple-leaf clover, a three-point star and a multiple-point star.

21. The toothbrush as claimed in claim 1, wherein a circumferential surface of the monofilament has a helical structure.

22. The toothbrush as claimed in claim 1, wherein said region of preferred breaking is at least partially defined by a void adjacent said first and second zones.

23. The toothbrush as claimed in claim 1, wherein said region of preferred breaking is at least partially defined by at least one indentation on an exterior surface of said bristle at a location adjacent said first and second zones.

24. A toothbrush bristle and a bristle carrier together forming a toothbrush, said bristle comprising a plastic monofilament defining in a cross-sectional area thereof at least first and second adjoining zones and at least one region of preferred breaking between said first and second zones, wherein at least one said zone comprises at least one filler material, and wherein adjacent said zones comprise different filler materials.

25. A toothbrush bristle and a bristle carrier together forming a toothbrush, said bristle comprising a plastic monofilament defining in a cross-sectional area thereof at least first and second adjoining zones and at least one region of preferred breaking between said first and second zones, and wherein adjacent said zones comprise different colorants.

26. A toothbrush bristle and a bristle carrier together forming a toothbrush, said-bristle comprising a plastic monofilament defining in a cross-sectional area thereof at least first and second adjoining zones and at least one region of preferred breaking between said first and second zones, and wherein a free end of the bristle is rounded.

27. The toothbrush as claimed in claim 26, wherein the first and second zones each comprise a first plastic material.

28. The toothbrush as claimed in claim 26, wherein the first zone comprises a first plastic material and the second zone comprises a second plastic material, and wherein said first plastic material differs from said second plastic material.

29. The toothbrush as claimed in claim 26, wherein said first and second zones each occupy approximately equal portions of the cross-sectional area.

30. The toothbrush as claimed in claim 26, wherein a major lateral dimension of the cross-sectional area of the monofilament is between 0.1 mm and 0.25 mm.

31. The toothbrush as claimed in claim 26, wherein the cross-sectional area comprises a shape selected from a group of shapes consisting of a three-leaf clover, a multiple-leaf clover, a three-point star and a multiple-point star.

32. The toothbrush as claimed in claim 26, wherein a circumferential surface of the monofilament has a helical structure.

33. The toothbrush as claimed in claim 26, wherein said region of preferred breaking is at least partially defined by at least one indentation on an exterior surface of said bristle at a location adjacent said first and second zones.

34. A method of manufacturing a toothbrush having a toothbrush bristle formed as a plastic monofilament having a cross-sectional area, comprising the steps of forming a first zone disposed over a first portion of said cross-sectional area, forming a second zone disposed over a second portion of said cross-sectional area adjacent said first portion, forming an interface between adjoining said first and second zones to define a region of preferred breaking along which said first and second zone are frangible, providing a bristle carrier, mounting an end of the bristle to the bristle carrier, and end-rounding a free end of the bristle.

35. The method of claim 34, wherein the first zone is formed comprising a first plastic material, the second zone is formed comprising a second plastic material, and wherein said first plastic material differs from said second plastic material.

36. The method of claim 34, wherein the first and second zones are each formed comprising a first plastic material.

37. The method of claim 34, wherein at least one said zone forms a boundary of a cavity.

38. The method of claim 34, wherein the first zone and second zones are formed by the steps of dividing and subsequently rejoining a melt flow forming the monofilament.

39. The method of claim 34, further comprising the steps of twisting the monofilament about its longitudinal axis, and fixing the twisted monofilament.

40. The method of claim 39, wherein the step of fixing further comprises treating with a chemical agent.

41. The method as claimed in claim 39, wherein the step of twisting further comprises drawing the monofilament from a rotating central reel.

42. The method as claimed in claim 39, wherein the step of twisting further comprises drawing the monofilament from a stationary central reel through a rotating nozzle.

43. The method of claim 34, further comprising the step of splitting the free end of the bristle in the preferred breaking region in a longitudinal direction.

44. The method of claim 43, wherein the step of splitting comprises subjecting the free end to a mechanical load.

45. The method as claimed in claim 43, wherein the step of end-rounding the free end of the bristle initiates the step of splitting.

46. The method as claimed in claim 34, wherein the step of end-rounding is performed subsequent to said step of mounting to the bristle carrier.

* * * * *

UNITED STATES PATENT AND TRADEMARK OFFICE

CERTIFICATE OF CORRECTION

PATENT NO. : 6,871,373 B2
DATED : March 29, 2005
INVENTOR(S) : Driesen et al.

It is certified that error appears in the above-identified patent and that said Letters Patent is hereby corrected as shown below:

Column 7,
Line 51, add after "end of the" -- bristle -- and add after "is split" -- over the --.

Signed and Sealed this

Twelfth Day of July, 2005

JON W. DUDAS
*Director of the United States Patent and Trademark Office*